US008769985B2

(12) United States Patent
Brugerolle et al.

(10) Patent No.: US 8,769,985 B2
(45) Date of Patent: Jul. 8, 2014

(54) LOW TEMPERATURE AIR SEPARATION PROCESS FOR PRODUCING PRESSURIZED GASEOUS PRODUCT

(75) Inventors: Jean-Renaud Brugerolle, Paris (FR); Bao Ha, San Ramon, CA (US)

(73) Assignee: L'Air Liquide, Société Anonyme à Directoire et Conseil de Surveillance pour l'Étude et l'Exploitation des Procédés Georges Claude, Paris (FR)

( * ) Notice: Subject to any disclaimer, the term of this patent is extended or adjusted under 35 U.S.C. 154(b) by 1737 days.

(21) Appl. No.: 11/572,048

(22) PCT Filed: Jul. 12, 2005

(86) PCT No.: PCT/EP2005/053315

§ 371 (c)(1),
(2), (4) Date: Aug. 27, 2008

(87) PCT Pub. No.: WO2006/005745

PCT Pub. Date: Jan. 19, 2006

(65) Prior Publication Data

US 2009/0007595 A1 Jan. 8, 2009

Related U.S. Application Data

(63) Continuation-in-part of application No. 10/890,650, filed on Jul. 14, 2004, now Pat. No. 7,272,954.

(51) Int. Cl.
*F25J 3/00* (2006.01)

(52) U.S. Cl.
CPC ..... *F25J 38/04018* (2013.01)
USPC ..... 62/643; 62/644

(58) Field of Classification Search
CPC ..... F25J 3/04054; F25J 3/04006–3/04048; F25J 2230/08; F25J 2230/24; F25J 2230/30
See application file for complete search history.

(56) References Cited

U.S. PATENT DOCUMENTS 5,084,081 A * 1/1992 Rohde ..... 62/656
5,379,598 A 1/1995 Mostello et al.

(Continued)

FOREIGN PATENT DOCUMENTS

EP 0 412 793 2/1991
EP 1 055 894 11/2000

(Continued)

OTHER PUBLICATIONS

International Search Report for PCT/EP2005/053315.

*Primary Examiner* — John F Pettitt
*Assistant Examiner* — Ignacio E Landeros
(74) *Attorney, Agent, or Firm* — Justin K. Murray

(57) ABSTRACT

A compressed air stream is cooled in an exchanger to form a compressed cooled air stream. The stream is then cryogenically compressed in a first compressor to form a first pressurized gas stream. The first pressurized gas stream is further cooled in the exchanger, cryogenically compressed in a second compressor, and then it is cooled and partially liquefied. The cooled and partially liquefied product is then fed to a system of distillation columns. A liquid product is removed from the system of distillation columns. This product is then pressurized, vaporized and warmed in the exchanger to yield pressurized gaseous product.

3 Claims, 5 Drawing Sheets

(56) References Cited

U.S. PATENT DOCUMENTS

| | | | | |
|---|---|---|---|---|
| 5,475,980 | A * | 12/1995 | Grenier et al. | 62/646 |
| 5,505,052 | A * | 4/1996 | Ekins et al. | 62/643 |
| 5,526,647 | A * | 6/1996 | Grenier | 62/654 |
| 5,901,576 | A * | 5/1999 | Agrawal et al. | 62/646 |
| 5,966,967 | A * | 10/1999 | Agrawal et al. | 62/650 |
| 6,543,253 | B1 * | 4/2003 | Schaub et al. | 62/643 |
| 6,626,008 | B1 | 9/2003 | Prosser et al. | |
| 2005/0126221 | A1 * | 6/2005 | Ha et al. | 62/643 |
| 2006/0010912 | A1 * | 1/2006 | Brugerolle et al. | 62/643 |
| 2011/0146343 | A1 * | 6/2011 | Ha et al. | 62/644 |

FOREIGN PATENT DOCUMENTS

| | | |
|---|---|---|
| FR | 1 318 477 | 2/1963 |
| FR | 1 321 269 | 3/1963 |
| WO | WO 2005 057112 | 6/2005 |

* cited by examiner

LOW TEMPERATURE AIR SEPARATION PROCESS FOR PRODUCING PRESSURIZED GASEOUS PRODUCT

BACKGROUND

Gaseous oxygen produced by air separation plants is usually at elevated pressure from about 20 to 50 bar. The basic distillation scheme is usually a double column process producing oxygen at the bottom of the low pressure column, operating at 1.4 to 4 bar. The oxygen must be compressed to higher pressure either by oxygen compressor or by the liquid pumped process. Because of the safety issues associated with the oxygen compressors, most recent oxygen plants are based on the liquid pumped process. In order to vaporize liquid oxygen at elevated pressure there is a need for an additional booster compressor to raise a portion of the feed air or nitrogen to higher pressure in the range of about 40 to 80 bar. In essence, the booster replaces the oxygen compressor. Pressurized air delivered by the booster compressor is condensed against the vaporizing liquid oxygen in a heat exchanger of the separation unit. This type of process is very power intensive and it is desirable to lower its power consumption when there exists another inexpensive supply of other forms of energy-latent streams, such as cryogenic liquid, pressurized gases, etc.

A typical liquid pumped process is illustrated in FIG. 1. In this type of process, atmospheric air is compressed by a Main Air Compressor (MAC) 1 to a pressure of about 6 bar absolute, it is then purified in an adsorber system 2 to remove impurities such as moisture and carbon dioxide that can freeze at cryogenic temperature to yield a purified feed air. A portion 3 of this purified feed air is then cooled to near its dew point in heat exchanger 30 and is introduced into a high pressure column 10 of a double column system in gaseous form for distillation. Nitrogen rich liquid 4 is extracted at the top of this high pressure column and a portion is sent to the top of the low pressure column 11 as a reflux stream. The oxygen-enriched liquid stream 5 at the bottom of the high pressure column is also sent to the low pressure column as feed. These liquids 4, 5 are subcooled before expansion against cold gases in subcoolers not shown in the figure for the sake of simplicity. An oxygen liquid 6 is extracted from the bottom of the low pressure column 11, pressurized by pump to a required pressure then vaporized in the exchanger 30 to form the gaseous oxygen product 7. Another portion 8 of the purified feed air is further compressed in a Booster Air Compressor (BAC) 20 to high pressure for condensation in the exchanger 30 against the vaporizing oxygen enriched stream. Depending upon the pressure of the oxygen rich product, the boosted air pressure can be around 65 bar or sometimes over 80 bar. The condensed boosted air 9 is also sent to the column system as feed for the distillation, for example to the high pressure column. Part of the liquid air may be removed from the high pressure column and sent to the low pressure column following subcooling and expansion. It is also possible to extract nitrogen rich liquid from the top of the high pressure column then pump it to high pressure (stream 13) and vaporize it in the exchanger in the same way as with oxygen liquid. A small portion of the feed air (stream 14) is further compressed and expanded into the column 11 to provide the refrigeration of the unit.

When a cryogenic liquid source is available at low cost, for example a liquid from a nearby air separation unit that produces liquid as a by-product, or a liquid produced by a liquefier that operates at night or during the time when power rates are low, or simply a low cost liquid from a surplus source, it is desirable to feed this liquid to the air separation plant to reduce its power consumption. However, when an air separation plant is fed with a liquid, some liquid products must be extracted from the plant by virtue of overall cold balance. However, since the liquid feed is already available at low cost, there is not much incentive to produce any significant amount of additional liquid products. Therefore, it is advantageous to provide a process capable of consuming those liquids efficiently.

The cold compression process as described in the prior art can be a good solution to the problem, since it uses the energy of refrigeration produced by the integrated expanders to yield efficient product compression.

A cold compression process, as described in U.S. Pat. No. 5,478,980, provides a technique to drive the oxygen plant with one single air compressor. In this process, air to be distilled is chilled in the main exchanger; then, further compressed by a booster compressor driven by a turbine exhausting into the high pressure column of a double column process. By doing so, the discharge pressure of the air compressor is in the range of 15 bar which is also quite advantageous for the purification unit. One inconvenience of this approach is the relatively high power consumption and an expander must be used to drive the process.

Some different versions of the cold compression process have also been described in U.S. Pat. No. 5,379,598, U.S. Pat. No. 5,901,576 and U.S. Pat. No. 6,626,008.

In U.S. Pat. No. 5,379,598, a fraction of feed air is further compressed by a booster compressor followed by a cold compressor to yield a pressurized stream needed for the vaporization of oxygen. This approach still has an expander as the main provider of refrigeration.

U.S. Pat. No. 5,901,576 describes several arrangements of cold compression schemes utilizing the expansion of vaporized rich liquid of the bottom of the high pressure column, or the expansion of high pressure nitrogen to drive the cold compressor. In some cases, motor driven cold compressors were also used.

U.S. Pat. No. 6,626,008 describes a heat pump cycle utilizing a cold compressor to improve the distillation process for the production of low purity oxygen for a double vaporizer oxygen process.

The prior art does not address the issue of using a liquid feed efficiently without having to produce other liquids or cold gas.

It is the purpose of this invention to provide an approach to solve this problem.

BRIEF SUMMARY OF THE INVENTION

According to this invention, there is provided a low temperature air separation process for producing pressurized gaseous product in an air separation unit using a system of distillation columns and a liquid feed stream derived from air, which comprises the following steps:

i) cooling a compressed air stream in an exchanger to form a compressed cooled air stream in the exchanger;

ii) cryogenically compressing at least a portion of the compressed cooled air stream in a first compressor having a first inlet temperature to form a first pressurized gas stream;

iii) cooling at least a portion of the first pressurized gas stream in the exchanger to form a first cooled pressurized gas stream;

iv) cryogenically compressing at least a portion of the first cooled pressurized gas stream in a second compressor having a second inlet temperature to form a second pressurized gas stream;

v) cooling and at least partially liquefying the second pressurized gas stream and feeding it to the system of distillation columns;

vi) feeding the system of distillation columns with the liquid feed stream; and vii) extracting a liquid product from the system of distillation columns, and then pressurizing, vaporizing, and warming at least part of the liquid product in the exchanger to yield a pressurized gaseous product.

In the context of this document, "derived from air" includes cooled purified air and mixture of air gases, which have been cooled and purified.

BRIEF DESCRIPTION OF THE SEVERAL VIEWS OF THE DRAWINGS

For a further understanding of the nature and objects for the present invention, reference should be made to the following detailed description, taken in conjunction with the accompanying drawings, in which like elements are given the same or analogous reference numbers and wherein.

DETAILED DESCRIPTION OF THE INVENTION

Figure 1:
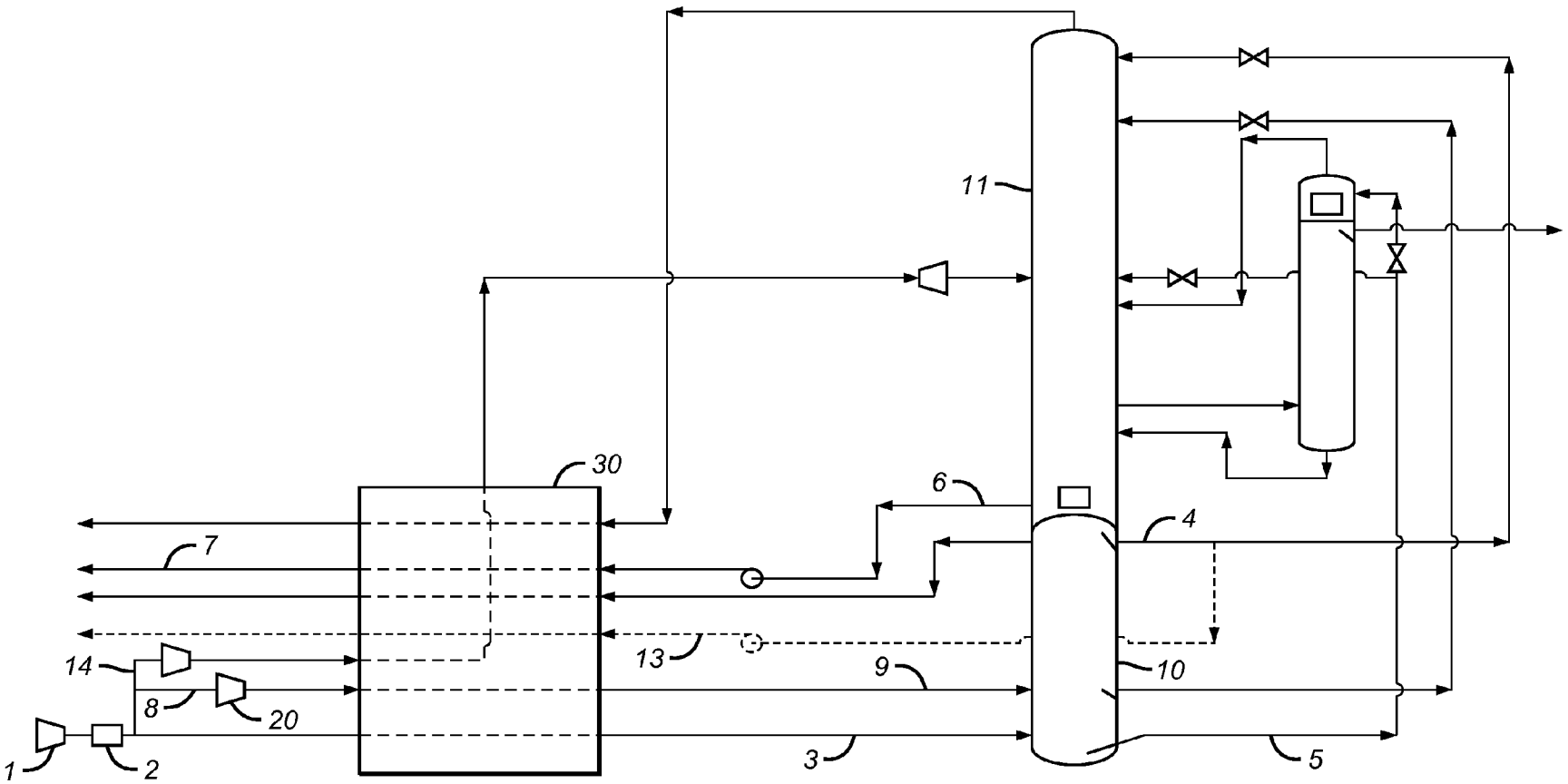
(PRIOR ART) FIG. 1
FIG. 1 illustrates prior art.

Compressed air substantially free of moisture and $CO_2$ (stream 1) at about 6 bar absolute is cooled in exchanger 65. A portion 52 with a flow rate about 20% of stream 1 is extracted from an intermediate point of exchanger 65 at cryogenic temperature—125° C. and sent to the first cold compressor 50 to be compressed to higher pressure of about 45 bar to yield the first pressurized gas stream 53. The compression heat increases the temperature of stream 53 and it will be again introduced at the warm end of heat exchanger 65 and cooled to yield the cooled first pressurized gas stream 55 also at about −125° C. A second cold compressor 51 will further compress stream 55 to yield the second pressurized gas stream 54 at about 60 bar. Stream 54 reintroduced at an intermediate point of heat exchanger 65, at least partially liquefied, cooled to about −176° C. and removed from the cold end of exchanger 65 as stream 56 to feed the high pressure distillation column 80 following expansion in a valve. The remaining portion 2 of compressed air is also fed in gaseous form to column 80 operated at about 6 bar. Nitrogen rich liquid 8 is withdrawn at the top of column 80 and sent to low pressure column 81 as reflux. A side stream 4 with composition close to air is optionally extracted from column 80 and sent to column 81 as feed. An oxygen enriched liquid stream 3 also called rich liquid is withdrawn at the bottom of 80 and fed to column 81 as reflux. The reflux streams are preferably subcooled before being sent to column 81. A source of liquid air 30 from storage tank 70 is fed to the column 81 as additional feed, its flow rate being about 10% mol. of the feed air 1. Liquid oxygen produced as stream 20 at the bottom of the low pressure column 81 is pumped by pump 21 to a high pressure of 40 bar and vaporized in exchanger 65 to yield gaseous oxygen product 22. Low pressure nitrogen rich gas 9 at a pressure of about 1.5 bar from column 81 is warmed in exchanger 65 and exits as stream 41. Medium pressure nitrogen gas 6 can be withdrawn from column 80 and warmed in exchanger 65 to yield medium pressure gaseous product 7. Argon production (not shown) can be optionally added to the process for argon production.

If the temperature of the outlet gas of the cold compressor 50 is much higher than ambient temperature, due to its high compression ratio, the compressor's outlet gas can be cooled by a water-cooled or air-cooled exchanger (not shown) before being introduced into exchanger 65 for cooling.

Figure 2:
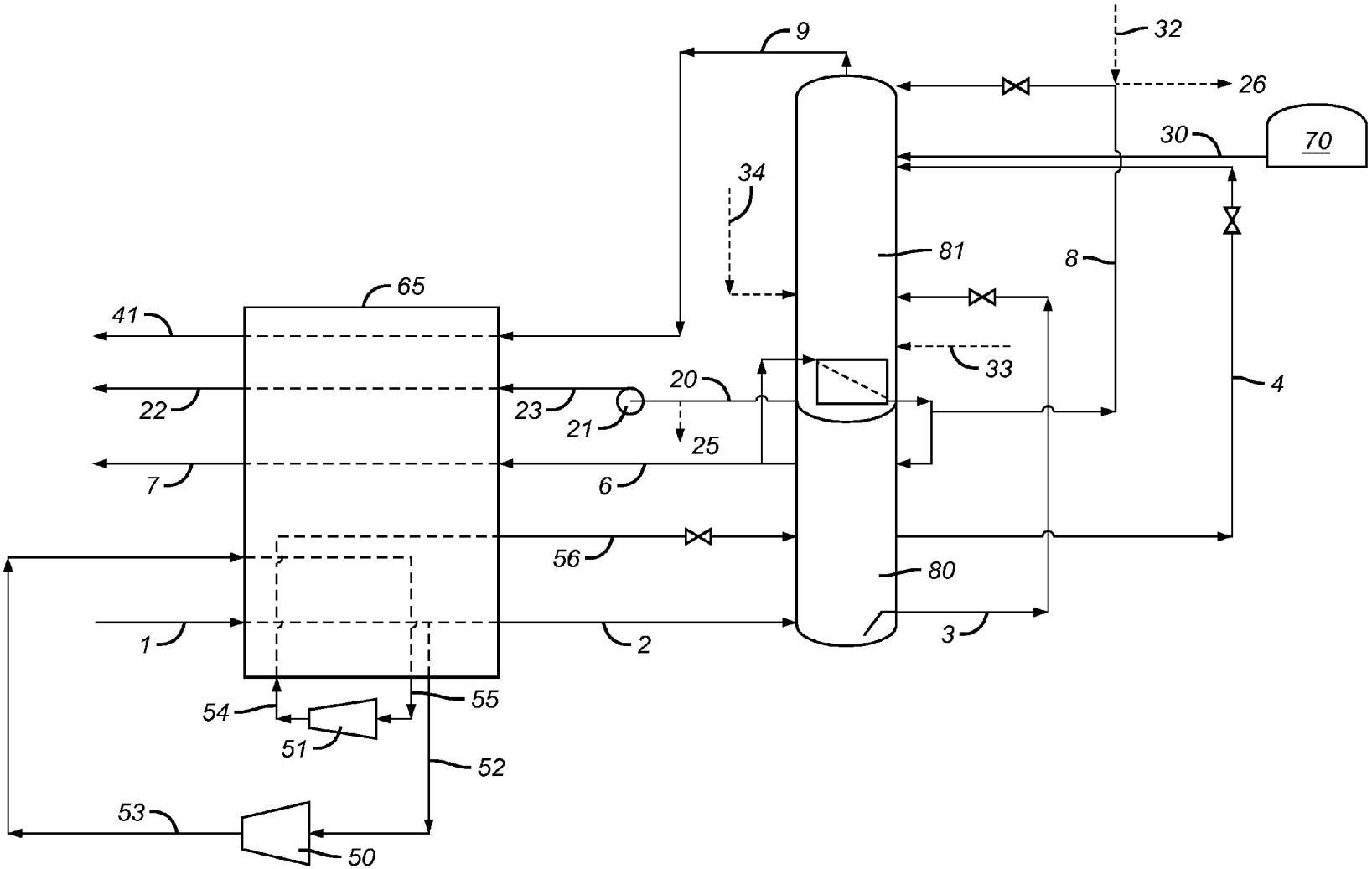
FIG. 2 illustrates one embodiment of the invention.

The source of liquid 30 is a product of air separation plant or liquefaction plant and can be of any composition of air components namely oxygen and nitrogen. It should not contain impurities that can be harmful to a safe and reliable operation of the plant such as hydrocarbons, moisture, or $CO_2$, etc. In FIG. 2, stream 30 is shown as liquid air or having similar composition as liquid air. If the liquid 30 is nitrogen rich liquid, it can be fed to column 81 as stream 32 shown in dotted line. If it is a rich liquid with similar composition as bottom liquid 3, it can be fed as stream 34 shown in dotted line. If it is liquid oxygen then it can be fed to the bottom of column 81 as stream 33 also shown in dotted line.

If the liquid 30 does contain some oxygen (for example liquid air, rich liquid or liquid oxygen) then the gaseous feed air stream 1 can be reduced in flow to yield the same balance in molecules of oxygen. By doing so the oxygen product flow 22 can remain unchanged.

It can be seen from the above description that the air separation unit operated with the embodiment shown in FIG. 2 can lower the power consumption of the unit significantly. Indeed, the booster air compressor (BAC) 20 of FIG. 1 is no longer needed, it is replaced by the two cold compressors 50 and 51. The cold gas extracted from the exchanger 65 is compressed economically at low temperature to higher pressure. The power consumed by this cold compression is low compared to a warm compression performed at ambient temperature. The power consumed by a compressor wheel is directly proportional to its inlet absolute temperature. A compressor wheel admitting at 100K would consume about ⅓ the power of a compressor wheel admitting at ambient temperature of 300K. Therefore, by utilizing cold compression, one can reduce significantly the power consumption of the compression. However, the compression heat is re-injected back into the system thus requiring additional refrigeration to evacuate it. In this process the source of liquid 30 provides such refrigeration needed to satisfy the heat balance. Furthermore, when liquid air or a liquid containing oxygen is fed to the system, as explained above, the flow rate of gaseous feed air 1 can be reduced resulting in further power saving. The temperature of streams 52 and 55 is selected to be preferably near the boiling temperature of liquid oxygen of stream 23. If the oxygen pressure is above its critical pressure then the temperature of streams 52 and 55 can be selected to be near to the critical temperature of the vaporizing stream 23. The term "near" indicates that the selected temperature is within 7° C. of the boiling temperature or the critical temperature of liquid oxygen As indicated above, if the source of liquid can be obtained inexpensively, there is not much economic incentive to produce liquid products. However from the technical point of view, it is possible to produce some liquids. In FIG. 2, when liquid air 30 is fed to the system, liquid oxygen product can be withdrawn as stream 25. Or, if preferred, liquid nitrogen stream 26 can be withdrawn. A portion of the refrigeration of stream 30 is simply transferred through the process to allow the extraction of those liquid products.

It will be noted that the shown apparatus does not include any turboexpanders. Thus the addition of cryogenic liquid 30 provides essentially all the refrigeration required by the process.

Of course, it is possible to equip the process with a turboexpander to produce liquid product during the periods when power rates are low, those liquid product is then fed to the process according to the invention during the periods when power rates are high to achieve the savings indicated in this invention. The turboexpander can be of any type, for example a Claude expander wherein cold elevated pressure air is expanded into the high pressure column of a double-column plant, or an air expander arranged such that air is expanded into the low pressure column, or a nitrogen expander wherein the high pressure nitrogen rich gas extracted from the high pressure column is expanded to lower pressure. The turboexpander, if so equipped, does not need to be operated during the time when liquid is fed to the system according to this invention, however, sometimes for the ease of operation or for the reduction of the quantity of liquid feed, it can be kept running. Multiple expanders are also possible.

If some high pressure nitrogen is desirable, one can pump liquid nitrogen product (not shown in FIG. 2) to high pressure and vaporize it in the heat exchanger 65.

Figure 3:
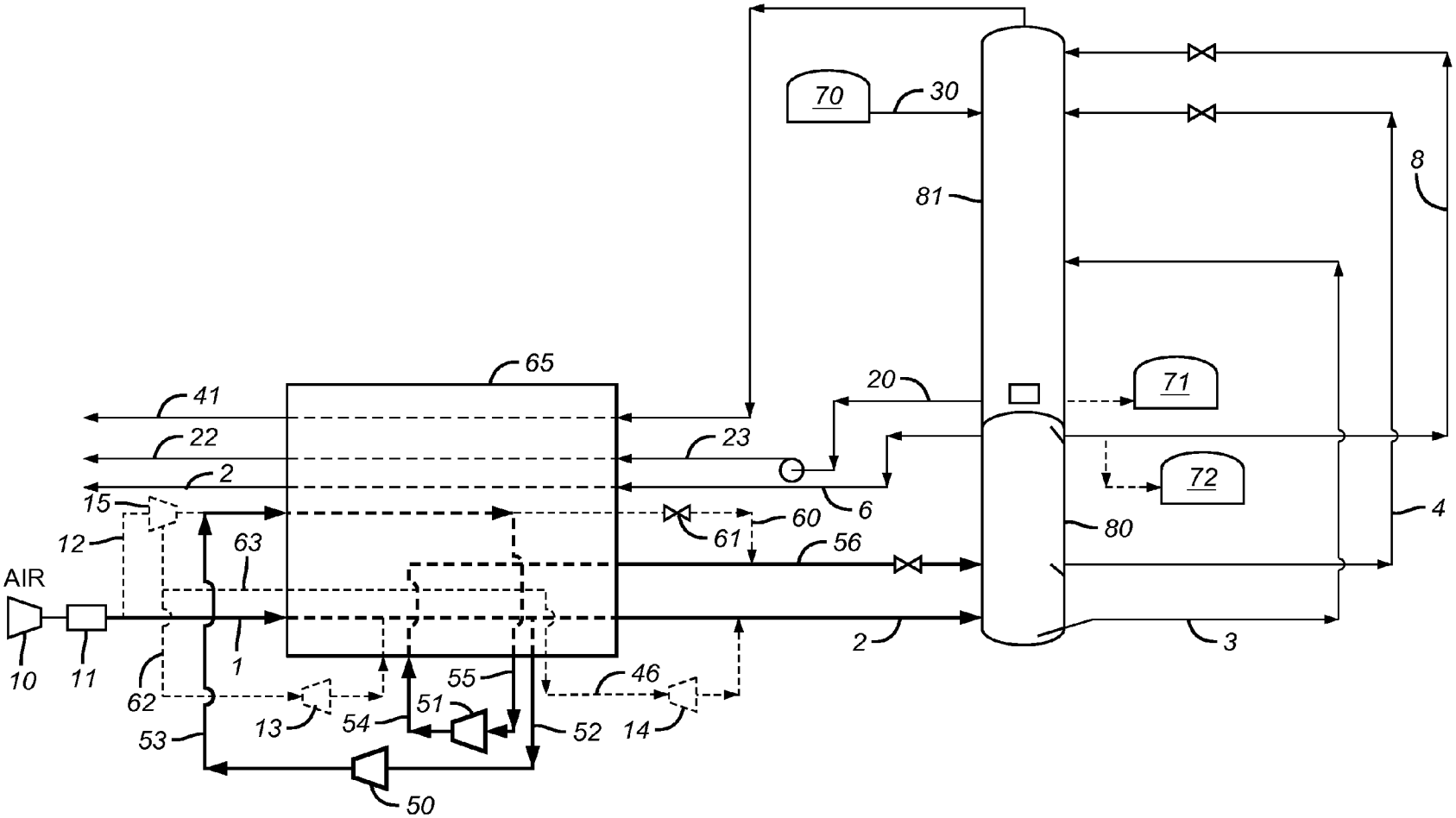
FIG. 3 illustrates another embodiment of the invention.
Figure 4:
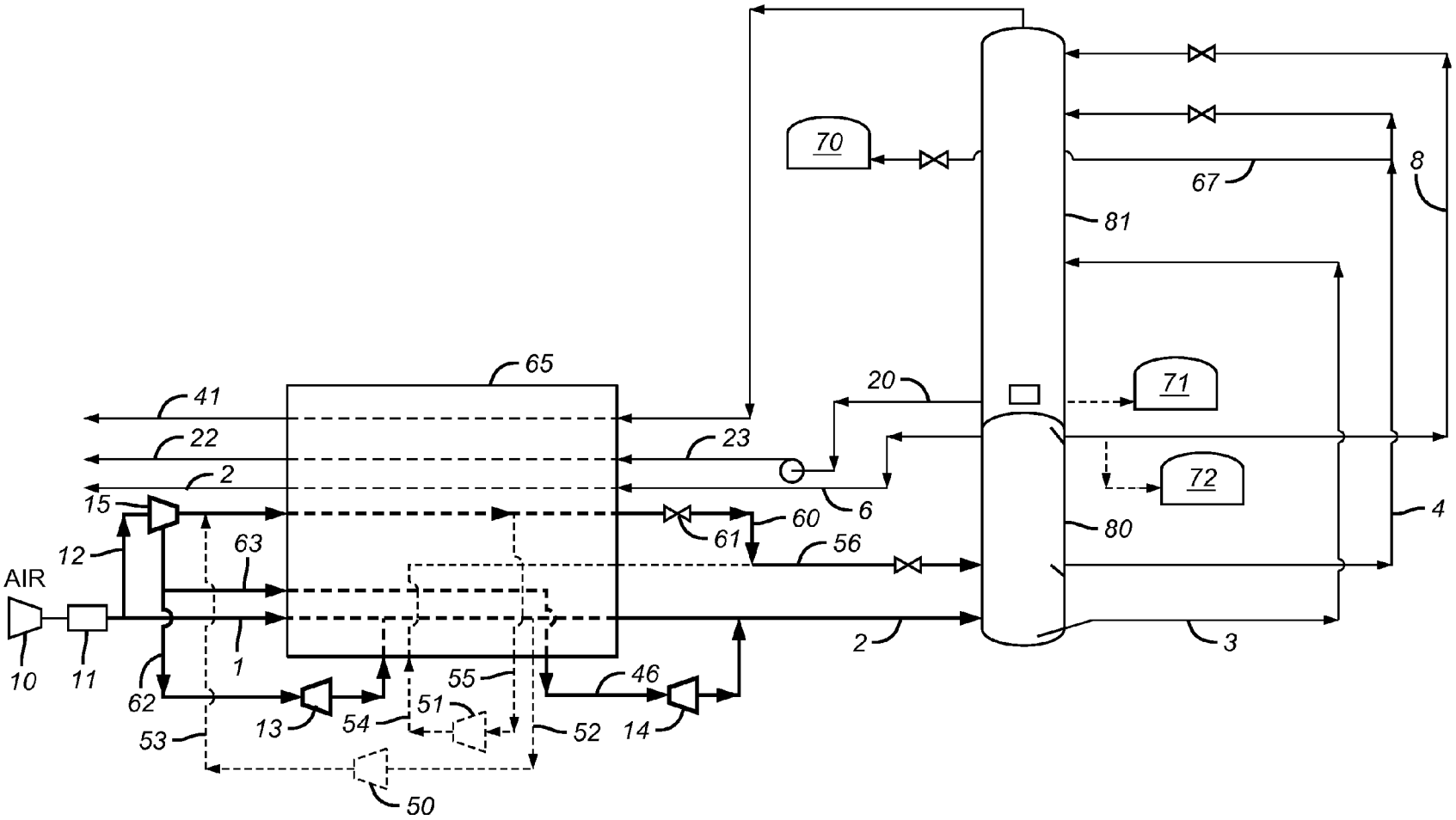
FIG. 4 illustrates one operational mode of the invention.
Figure 5:
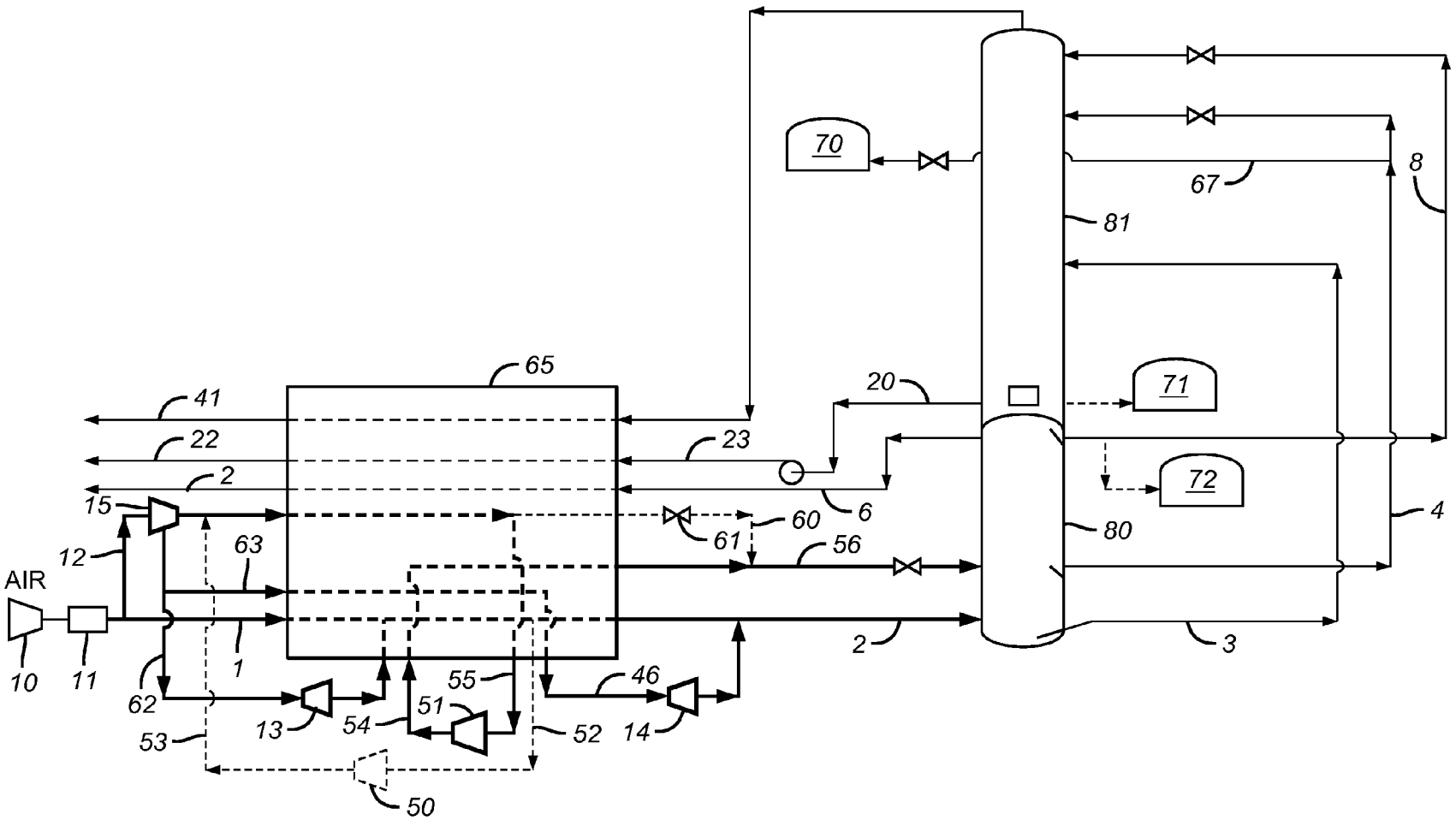
FIG. 5 illustrates a second operational mode of the invention.

FIGS. 3, 4 and 5 show the same apparatus and illustrate the processes used during a peak period for FIG. 3 and two alternative modes of operation to be used during off-peak periods in FIGS. 4 and 5. Liquids can be produced during off-peaks and fed back to the cold box during peaks. An external independent liquefier can also be used instead to supply the required refrigeration. Some other means of producing refrigeration such as refrigeration units or Freon™ units can also be used in conjunction with the above refrigeration equipment.

The process uses a standard double column, including a high pressure column 80 and a low pressure column 81. Air is compressed in compressor 10 and substantially freed of moisture and $CO_2$ (stream 1) by purification unit 11 at about 6 bar absolute. The compressed purified air 1 is cooled in exchanger 65. For all of FIGS. 3, 4 and 5, faint lines indicate a conduit which is not in operation and bold lines indicate a conduit which is in operation.

When the cost of electricity is above a predetermined level (peak), as shown in FIG. 3, a portion 52 with a flow rate about 20% of stream 1 is extracted from an intermediate point of exchanger 65 at cryogenic temperature −125° C. and sent to the first cold compressor 50 to be compressed to higher pressure of about 45 bar to yield the first pressurized gas stream 53. The compression heat increases the temperature of stream 53 and it will be again introduced at the warm end of heat exchanger 65 and cooled to yield the cooled first pressurized gas stream 55 also removed from the exchanger 65 at about −125° C. A second cold compressor 51 will further compress stream 55 to yield the second pressurized gas stream 54 at about 60 bar. Stream 54 is reintroduced at an intermediate point of heat exchanger 65, at least partially liquefied, cooled to about −176° C. and removed from the cold end of exchanger 65 as stream 56 to feed the high pressure distillation column 80 following expansion in a valve. The remaining portion 2 of compressed air is also fed in gaseous form to column 80 operated at about 6 bar. Nitrogen rich liquid 8 is withdrawn at the top of column 80 and sent to low pressure column 81 as reflux. A side stream 4 with composition close to air is optionally extracted from column 80 and sent to column 81 as feed. An oxygen enriched liquid stream 3 also called rich liquid is withdrawn at the bottom of column 80 and fed to column 81 as feed. The reflux and feed streams are preferably subcooled before being sent to column 81. A source of liquid air 30 from storage tank 70 is fed to the column 81 as additional feed, its flow rate being about 10% mol. of the feed air 1. Liquid oxygen produced as stream 20 at the bottom of the low pressure column 81 is pumped by pump 21 to a high pressure of 40 bar and vaporized in exchanger 65 to yield gaseous oxygen product 22. Low pressure nitrogen rich gas 9 at a pressure of about 1.5 bar from column 81 is warmed in exchanger 65 and exits as stream 41. Medium pressure nitrogen gas 6 can be withdrawn from column 80 and warmed in exchanger 65 to yield medium pressure gaseous product 7. Argon production (not shown) can be optionally added to the process for argon production.

If the temperature of the outlet gas of the cold compressor 50 is much higher than ambient temperature, due to its high compression ratio, the compressor's outlet gas can be cooled by a water-cooled or air-cooled exchanger (not shown) before being introduced into exchanger 65 for cooling.

The source of liquid 30 can be derived from the air separation plant itself. In this mode, the turbines 13 and 14 and warm compressor 15 are not operational.

FIG. 4 illustrates an operating mode during a period when the cost of electricity is below a predetermined level (off-peak). In this mode, both cold compressors 50 and 51 can be stopped, the cooled compressed air stream is separated upstream of the exchanger 65 into a stream 12 and a stream 1. Stream 12 is compressed in a warm booster compressor 15. A stream removed at an intermediate stage of booster compressor 15 is divided in two, one part being sent without further cooling to turbine 13 and the rest 46 being cooled to an intermediate temperature of the exchanger 65 and then sent to turbine 14. The expanded streams are mixed with stream 1 and sent to the high pressure column 80 in gaseous form. The expanders 13 and 14 provide the needed refrigeration for the production of liquid products. Liquid air is removed from line 60 through by-pass valve 61 and sent to the high pressure column 80 as stream 56. A stream 67 with a composition similar to air is extracted from stream 4 and sent to storage tank 70. This liquid air will be fed to the cold box in the subsequent phase (such as that of FIG. 3) when the cold compressors are in operation. Some liquid oxygen and nitrogen can be optionally produced and sent to storage tanks 71 and 72. It can be seen that in this mode, the warm booster compressor 15 replaces the cold compressors 50 and 51.

Another variant of the off-peak mode is described in FIG. 5: Instead of being stopped, the cold compressor 51 can be kept running and only the cold compressor 50 is stopped. To indicate this, the lines to cold compressor 50 are shown as faint dotted lines. This allows simpler operation since only one cold compressor needs to be started or stopped when changing modes. A portion 12 of the compressed air after the purification unit 11 is sent to a warm booster compressor 15 for further compression. A side stream 64 is extracted at an interstage of compressor 15 and is split into two portions 62 and 63. Stream 62 feeds expander 13 and stream 63 is cooled to form stream 46 which feeds expander 14. The expanders 13 and 14 provide the needed refrigeration for the production of liquid products. Expander 13 has an inlet temperature at about ambient temperature (or below ambient temperature if a refrigeration unit is used) and expander 14 has an inlet temperature which is an intermediate temperature of the exchanger 65. Expanded air from both expanders 13 and 14 is mixed with air stream 1 and sent in gaseous form to column 80 as stream 2. Pressurized air from the final stage of compressor 15 is cooled, removed from the exchanger 65 as stream 55 then fed to cold compressor 51. Stream 54 from the discharge of cold compressor 51 is further cooled and liquefied in exchanger 65 then feed the high pressure column 80 via line 56. It can be seen that in this mode, the warm booster compressor 15 replaces the cold compressor 50.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

What is claimed is:

1. An apparatus which may be used for producing pressurized gaseous product comprising:

a heat exchanger configured to cool a compressed air stream thereby producing a cooled compressed air stream, the heat exchanger having a warm side, a cool side, a first intermediate point, and a second intermediate point;

a first compressor in fluid communication with the heat exchanger, the first compressor configured to receive a fluid from the first intermediate point of the heat exchanger, compress the fluid, and then introduce the compressed fluid to the warm side of the heat exchanger;

a second compressor in fluid communication with the heat exchanger, the second compressor configured to receive a second fluid from the second intermediate point of the heat exchanger, compress the second fluid thereby producing a compressed second fluid, and then introduce the compressed second fluid back to the heat exchanger;

a first column in fluid communication with the cool side of the heat exchanger, the first column configured to receive the cooled compressed air stream and the compressed second fluid;

a second column in fluid communication with the first column, the second column comprising a liquid oxygen extraction port, the liquid oxygen extraction port disposed proximate a bottom portion of the second column, wherein the liquid oxygen extraction port is in fluid communication with the cool side of the heat exchanger; and a liquid storage tank in fluid communication with a liquid outlet of the first column, wherein the liquid storage tank is operable to receive a liquid from the liquid outlet of the first column when electricity costs are below a predetermined level wherein the liquid storage tank is also in fluid communication with a liquid inlet of the second column such that the liquid storage tank is operable to introduce the liquid from the liquid storage tank into the second column when electricity costs are at or above a predetermined level.

2. The apparatus as claimed in claim 1, further comprising:

a warm booster compressor configured to compress a portion of the compressed air stream, wherein the warm booster compressor is in fluid communication with the heat exchanger;

a first turbo expander in fluid communication with the warm booster compressor, the first turbo expander configured to reduce the pressure of a warm fluid stream received from the warm booster compressor, the first turbo expander in fluid communication with heat exchanger, wherein the first turbo expander is operable to provide cooling to the apparatus; and a second turbo expander in fluid communication with the heat exchanger, wherein the second turbo expander is configured to receive a cold fluid from the heat exchanger that has been compressed by the warm booster compressor, wherein the second turbo expander is operable to provide cooling to the apparatus.

3. The apparatus as claimed in claim 1, wherein liquid air is disposed within the liquid storage tank.

* * * * *